US009066550B2

(12) United States Patent
Erb et al.

(10) Patent No.: US 9,066,550 B2
(45) Date of Patent: Jun. 30, 2015

(54) PIVOTING DUAL CHIN STRAP SNAP FEATURE FOR FOOTBALL HELMET

(71) Applicant: Kranos IP Corporation, Litchfield, IL (US)

(72) Inventors: Robert Erb, Plandome, NY (US); Cortney Warmouth, Edwardsville, IL (US); Vincent R. Long, St. Peters, MO (US); Louis Anthony Vanhoutin, Luka, IL (US)

(73) Assignee: KRANOS IP CORPORATION, Litchfield, IL (US)

( * ) Notice: Subject to any disclaimer, the term of this patent is extended or adjusted under 35 U.S.C. 154(b) by 267 days.

(21) Appl. No.: 13/691,083

(22) Filed: Nov. 30, 2012

(65) Prior Publication Data

US 2014/0150168 A1 Jun. 5, 2014

(51) Int. Cl.
*A42B 3/08* (2006.01)

(52) U.S. Cl.
CPC ..... *A42B 3/08* (2013.01)

(58) Field of Classification Search
CPC ..... A41B 3/00; A41D 2300/324; A42B 3/08; A42B 3/185
USPC ..... 2/410, 421, 422, 425, 424; 24/324, 24/578.1, 578.12, 578.15, 586.11, 588.12, 24/590.1
See application file for complete search history.

(56) References Cited

U.S. PATENT DOCUMENTS

| | | | | | |
|---|---|---|---|---|---|
| 2,349,264 | A | * | 5/1944 | Grice | 2/322 |
| 2,585,894 | A | * | 2/1952 | Becker | 24/324 |
| 2,585,900 | A | * | 2/1952 | Van Buren, Jr. | 24/324 |
| 3,166,761 | A | * | 1/1965 | Strohm | 2/421 |
| 3,187,342 | A | * | 6/1965 | Aileo | 2/421 |
| 3,513,482 | A | * | 5/1970 | Holden | 2/421 |
| 4,051,556 | A | * | 10/1977 | Davenport et al. | 2/421 |
| 4,062,068 | A | * | 12/1977 | Davenport et al. | 2/421 |
| 4,398,306 | A | * | 8/1983 | Gooding | 2/421 |
| 4,646,368 | A | | 3/1987 | Infusino et al. | |
| 4,651,356 | A | | 3/1987 | Zide | |
| 4,692,947 | A | * | 9/1987 | Black et al. | 2/421 |
| 4,831,668 | A | | 5/1989 | Schulz | |
| 4,903,349 | A | * | 2/1990 | Arai | 2/421 |
| 4,918,753 | A | * | 4/1990 | Mermillod | 2/10 |
| 5,347,660 | A | * | 9/1994 | Zide et al. | 2/421 |
| 5,946,735 | A | | 9/1999 | Bayes | |
| 5,987,652 | A | * | 11/1999 | Fowler | 2/424 |
| 6,481,024 | B1 | * | 11/2002 | Grant | 2/421 |
| 6,711,751 | B1 | * | 3/2004 | Muskovitz | 2/410 |
| 6,845,548 | B1 | * | 1/2005 | Lin | 24/265 BC |
| 7,246,384 | B2 | * | 7/2007 | Bentz | 2/421 |
| 7,475,453 | B2 | * | 1/2009 | Drake et al. | 24/324 |
| 7,900,279 | B2 | * | 3/2011 | Kraemer et al. | 2/425 |

(Continued)

OTHER PUBLICATIONS http://www.alibaba.com/product-free/101356865/China_Shearling_Trapper_Hat_with_a.html.

*Primary Examiner* — Alissa L Hoey

(74) *Attorney, Agent, or Firm* — Notaro, Michalos & Zaccaria P.C.

(57) ABSTRACT

A football helmet having a shell, and having a chin protector with chin cup and chin straps, has dual snaps on its chin strap buckles and dual snaps on each side of the helmet shell for improving the snap connection between the chin straps and the helmet to reduce the chances the helmet wearer will loose the helmet during play. Dual snaps on the sides of the helmet are carried on pivoting snap carriers to allow the chin protector to rotate with respect to the helmet shell.

9 Claims, 4 Drawing Sheets

(56) References Cited

U.S. PATENT DOCUMENTS

| | | | | |
|---|---|---|---|---|
| 8,056,151 | B2 * | 11/2011 | Bologna et al. | 2/421 |
| 8,745,762 | B2 * | 6/2014 | Lamanna et al. | 2/6.3 |
| 2002/0148081 | A1 * | 10/2002 | Ide et al. | 24/324 |
| 2007/0193006 | A1 | 8/2007 | Kitano et al. | |
| 2008/0000015 | A1 * | 1/2008 | Sutter et al. | 2/410 |
| 2008/0000016 | A1 * | 1/2008 | Kellogg | 2/410 |
| 2008/0028500 | A1 | 2/2008 | Bentz | |
| 2008/0092277 | A1 | 4/2008 | Kraemer et al. | |
| 2010/0192286 | A1 * | 8/2010 | Bologna et al. | 2/421 |
| 2011/0094018 | A1 * | 4/2011 | Rogers et al. | 2/421 |
| 2011/0265237 | A1 * | 11/2011 | Lazar et al. | 2/10 |
| 2011/0289660 | A1 * | 12/2011 | Gowen | 2/421 |
| 2013/0117913 | A1 * | 5/2013 | Rogers et al. | 2/421 |
| 2014/0068844 | A1 * | 3/2014 | Infusino et al. | 2/421 |

* cited by examiner

PIVOTING DUAL CHIN STRAP SNAP FEATURE FOR FOOTBALL HELMET

FIELD AND BACKGROUND OF THE INVENTION

The present invention relates generally to the field of protective sports equipment and in particular to a new and useful improvement for chin straps and their attachment to football helmets.

Football is an extremely physical, high-contact sport. As a result, it is extremely important that players on the field be wearing protective helmets at all times during game play. Unfortunately, the same roughness that makes wearing a helmet so important can also cause players to lose their helmets in the melee on the field.

This problem is well-recognized and has not been solved by current helmet technology. For example, data collected during the 2011 National Collegiate Athletic Association ("NCAA") collegiate football season indicated that helmets came off of players more than two times per game.

The problem of helmets coming off of football players has actually made new rules necessary. The NCAA and other associations with rule making authority concerning football have passed various rules that are effective for the 2012 season to enhance student-athlete safety. Among these new rules is a rule concerning "Loss of Helmet During Play" that states that if a player loses his helmet during play, other than as the result of a foul by an opponent, it will be treated like an injury so that the player must leave the game and is not allowed to participate for the next play. Additionally, if a player loses his helmet, he is not allowed to continue to participate in that play, to protect him from injury. Thus, besides being a threat to player safety, helmet loss can put teams at a temporary competitive disadvantage.

Chin straps are crucial for keeping helmets in place during game play. Players are generally expected to have their helmet chin straps snapped on when they are on the field, both to protect their chin and to hold the helmet on their head. When a strap loosens or pops off during a play it threatens the player and hurts their team. At the same time, players need to detach at least one side of the chin strap to remove their helmet, often several times a game, such as when their unit leaves the field when an offensive series begins or ends, or when a substitution is made. Thus, an ideal chin strap is strong enough to stay on during play, but also easy and fast to attach and detach throughout each game.

The concept of using double snaps on a chin strap is not known for football helmets, but is known in different applications, for example, as used in a China Shearling Trapper hat available from http://www.alibaba.com/product-free/101356865/China_Shearling_Trapper_Hat_with_a.html. This hat has two snaps on its securing strap but only one is used at a time because there is only one snap on an opposite side of the hat. The two snaps are thus used to provide two sizes for the strap and not to better secure the hat.

The concept of a broadly adjustable chin strap which uses velcro instead of snaps is disclosed by U.S. Pat. No. 5,946,735. Published patent application US2008/0028500 discloses the known use of a single snap buckle in combination with a screw-on male snap for a football helmet. Also see U.S. Pat. No. 4,651,356 and published patent application US2007/0193006.

Published patent application US2008/0092277 attempts to solve the helmet retention problem using a non-pivoting clamp for securing a chin strap to a helmet. The use of redundant pivoting snaps on a chin strap to engage redundant snap-receivers on a football helmet shell is not known, however.

SUMMARY OF THE INVENTION

It is an object of the present invention to provide football helmets with greater resistance to accidentally coming off during game play.

It is also an object of the present invention to increase the strength of easily-reversible snap attachments between football helmets and chin straps.

It is a further object of the invention to provide reinforced snap attachments between football helmets and chin straps that allow the chin straps and a chin cup to rotate relative to the helmet shell.

Accordingly, the present invention provides football chin strap attachments which are reinforced by providing dual snap connections between chin straps and helmet shells.

In another aspect of the invention, multiple pairs of snap connectors are provided on multiple carrying components which can rotate with respect to the helmet shell. This combines the strength advantages and reversibility of paired snaps with the angular flexibility of a single rotatable snap.

In one embodiment of the invention, a football helmet combination includes a rigid plastic shell adapted to cover the head of a wearer, a face cage, and a chin protector adapted to cover the chin of the wearer and to hold the shell to the wearer's head, and at least one pair of chin straps connected to the chin cup and extending to the opposite side portions of the shell. The helmet combination also includes a plurality of buckles, each having connector means for connecting each buckle along a length of one of the chin straps, each buckle having a pair of first snaps of male type, female type, or one of each type.

There is also at least one snaps set on each of the opposite sides of the helmet shell, each snap set being for snapping connection to one of the buckles, and comprising a pair of second snaps being spaced the same distance apart as the pairs of first snaps. Each of the second snaps may be either a male female type, being selected to snap to a respective first snap of the buckles. In a most preferred embodiment, some or all of the snaps set are rotatably attached to the rigid plastic shell by pivoting connectors.

The first snaps and second snaps are adapted for securely and reversably snap connecting each chin strap to a side portion of the shell via a buckle and a snaps set.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
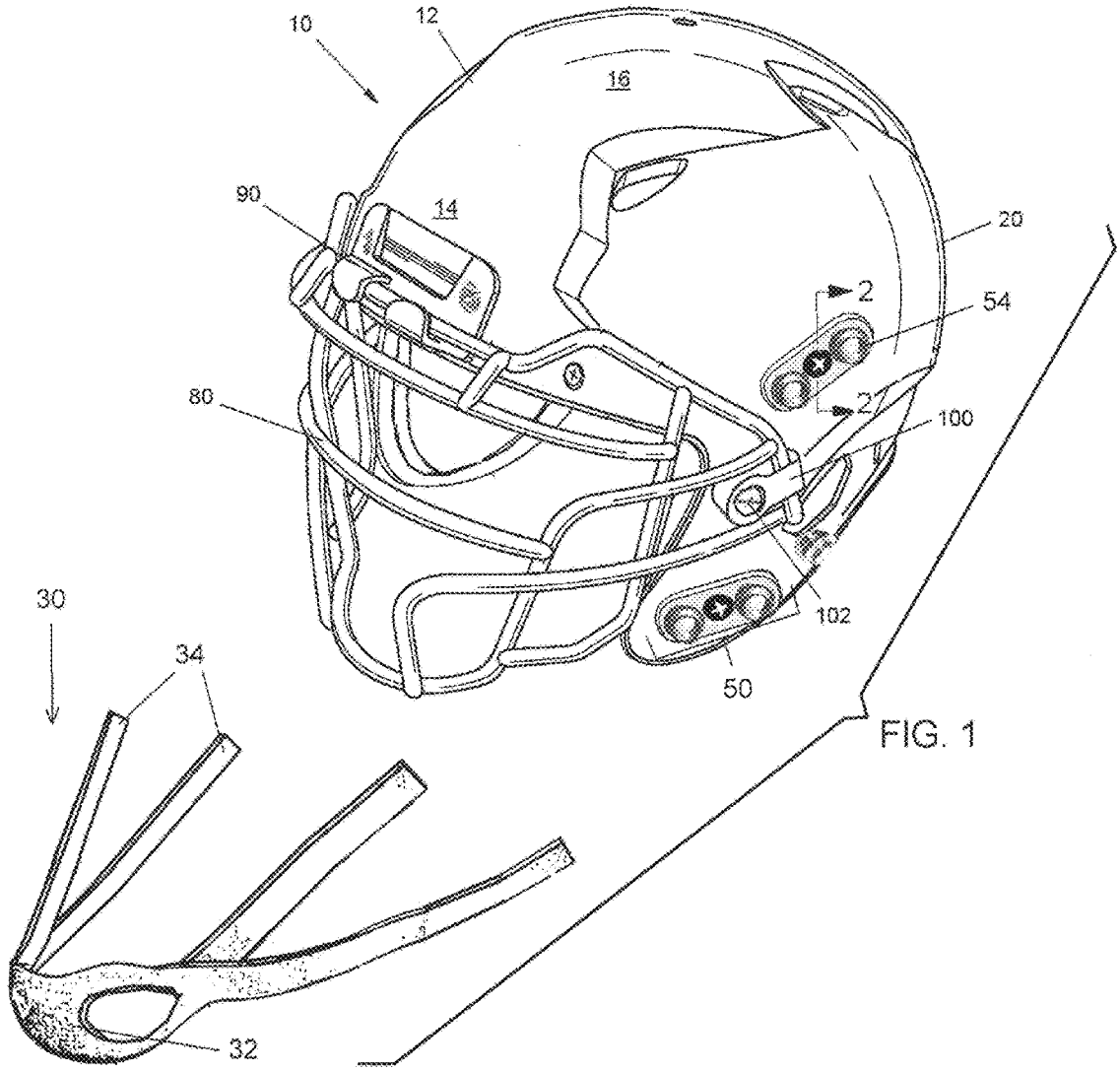
FIG. 1 is a top perspective view of a helmet of the present invention and a chin protector.

Referring now to the drawings, in which like reference numerals are used to refer to the same or similar elements, FIG. 1 is a preferred helmet 10 of the present invention and a chin protector 30 that can be used with the helmet.

The preferred football helmet combination 10 includes a rigid plastic shell 12 comprising, for example, molded polycarbonate, although other helmet materials known in the art may be used. The rigid shell 12 comprises front 14, crown 16, and opposite side 18 portions, the sides including parts of the helmet at least as high as the wearer's temple region which may include openings for ventilation or for attaching other components. The interior of the helmet will typically include padding (not shown). The helmet includes a face mask 80, which is rigidly attached to the shell 12 such as by side attachments 102 and a top attachment 90.

The football helmet combination 10 includes a chin protector 30 adapted to cover the chin of the wearer and to hold the shell and face mask of the helmet on the wearer's head. The chin protector 30 typically includes a chin cup 32 and at least two chin straps 34 attached to the chin cup. Often four chin straps will be provided, as shown in FIG. 1, two for attaching to each side of the helmet. The chin straps are used to attach the chin protector to the shell 12, preferably including at the sides 18. The chin straps engaged to one or both sides of the shell are selectably separable from the shell on one or, preferably, both sides.

Figure 4:
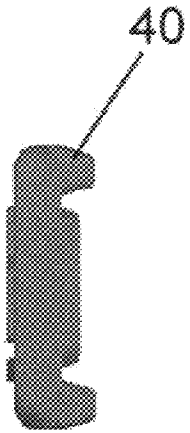
FIG. 4 is an enlarged side view of the buckle of FIG. 3 viewed from a narrow end.
Figure 3:
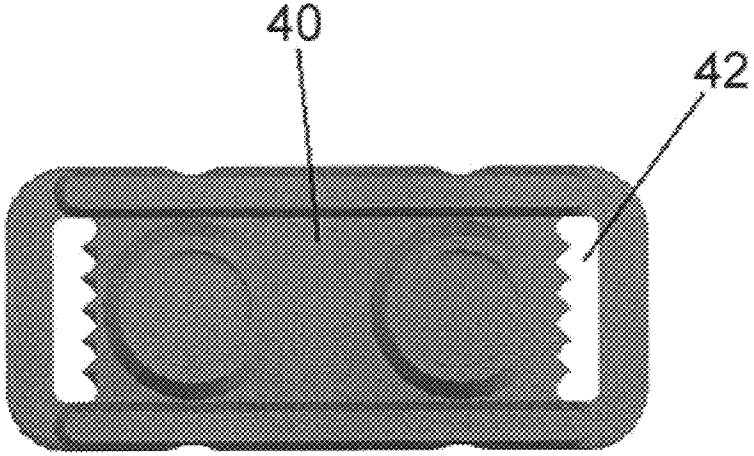
FIG. 3 is an enlarged view of the top side of a buckle.
Figure 5:
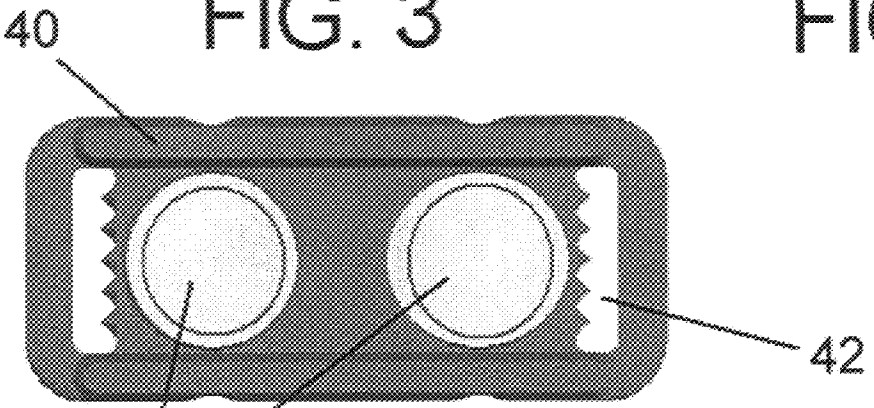
FIG. 5 is an enlarged bottom view of the buckle of FIGS. 3 and 4 showing two spaced-apart first snaps.

The chin protector is preferably attached to the shell 12 using a plurality of buckles, such as those shown in FIGS. 3-5. Each chin strap 34 is engaged to a buckle, for example, by threading the strap through slots 42 in the buckle. Other connector means such as, for example, clamps, screws or additional snaps may also be used to connect the buckles 40 to the chin straps 34. Preferably the buckles can be moved up and down the length of the chin strap, including off of the strap. This allows the chin protector to be adjusted to fit different wearers by bringing the chin cup 32 closer to or further from the other parts of the helmet. This also allows buckles to be added and removed from each strap. Each buckle comprises a pair of first snaps 44. Each buckle may include two male snaps, two female snaps, or one of each type. The example shown in FIG. 5 includes two female snaps. A variety of male-to-female snap connectors known in the art can be adapted for use with this invention. More than two snaps on each buckle is also possible.

Figure 2:
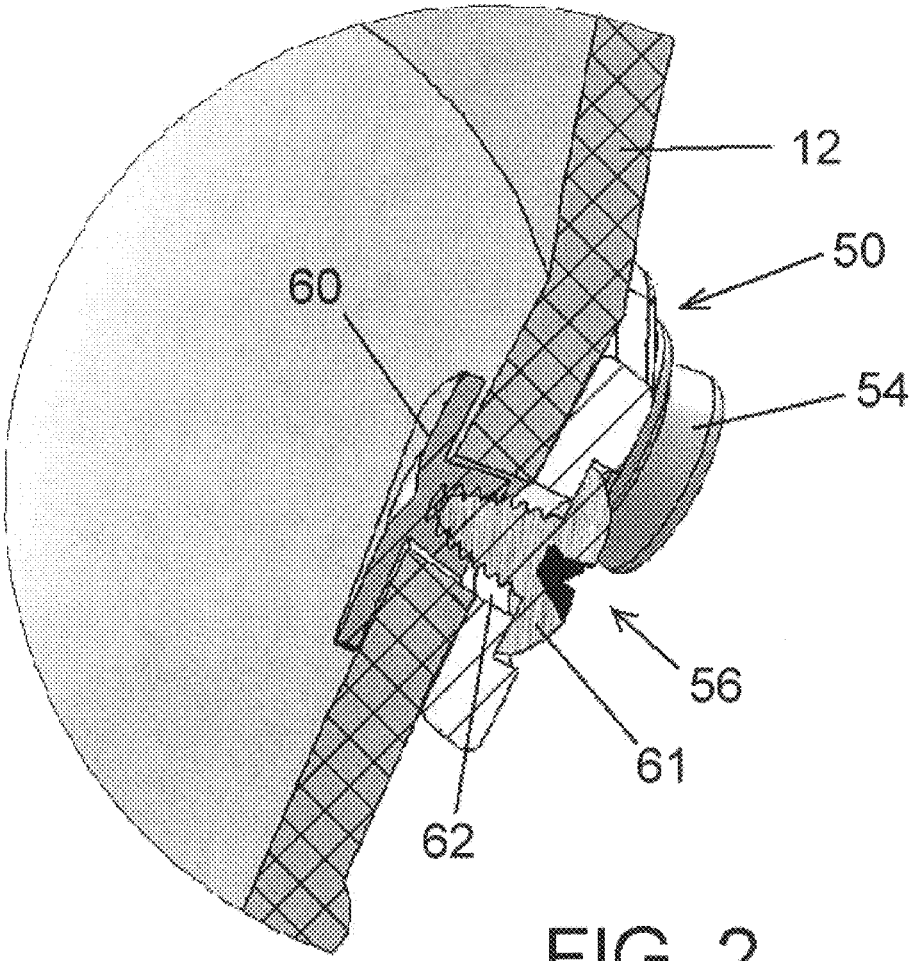
FIG. 2 is an enlarged sectional view of part of a helmet, including a snap set, along line 2-2 shown in FIG. 1.
Figure 6:
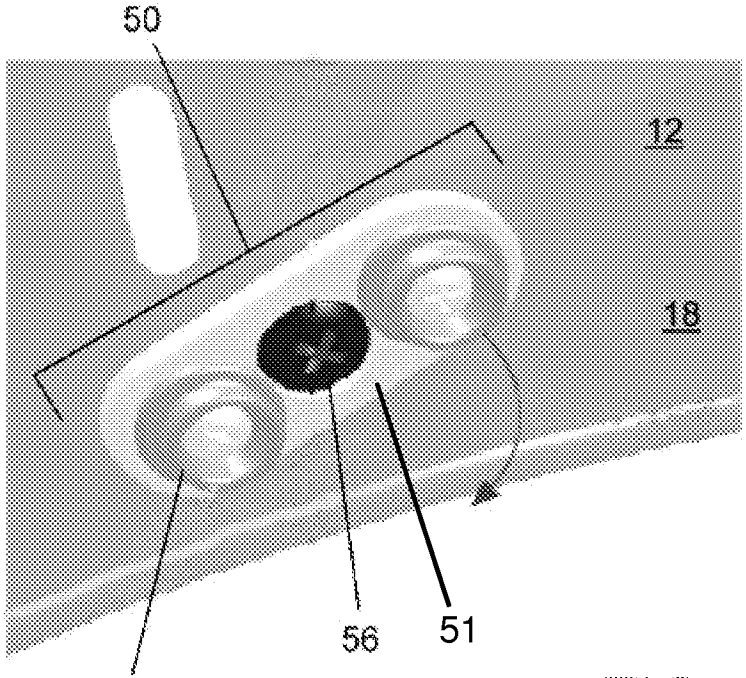
FIG. 6 is an enlarged view of a side portion of a helmet and a pivoting snap set rotatably attached to the helmet.

The helmet 10 preferably includes one or more snaps sets 50 on each side 18 of the shell 12, each snap set typically including a base 51 carrying one or more snaps. The example shown in FIG. 1 includes two snaps sets 50 on each side of the helmet, although only two of the four snaps sets in this embodiment are depicted because only one side of the helmet is visible. FIG. 2 shows an enlarged section through a portion of a helmet shell 12, corresponding to line 2-2 in FIG. 1, where a snap set 50 is attached to the shell. FIG. 6 depicts an enlarged rotatable snap set, and arrow indicating one possible direction of rotation. In the preferred embodiment, each snap set includes a pair of second snaps 54 spaced the same distance apart as the first snaps 44 on the buckles 40 to be used with that helmet. The pair of second snaps 54 of each snap set 50 may include two male snaps, two female snaps, or one of each, so long as they complement the snaps on the buckle they are designed to engage. The snaps sets 50 shown in FIGS. 1 and 6 each include two male snaps, although other arrangements are within the scope of the invention. The male type snaps may each comprise a round protrusion. See FIGS. 1, 2, and 6. The female type snaps may each comprise a round cavity complimentary to the round protrusions of said male type snaps and shaped for receiving said round protrusions. See FIG. 5.

Typically, two first snaps 44 of each buckle 40 will be complimentary to two similarly-spaced second snaps 54 on a snaps set 50 attached to the helmet. Each buckle 40 is engaged to one of the chin straps 34 of the chin protector 30. Each buckle snaps into engagement with a corresponding snaps set using two snap fasteners, thus reversably attaching a chin strap to the shell 12, via a snaps set 50, with greater strength than a single snap fastener can provide. The snaps are preferably designed or selected so that the connection is strong enough to not come undone accidentally during game play, but are not so strong that a player cannot deliberately disconnect them when necessary. Snaps already known in the art, such as those historically used one at a time on football helmets, may be used for this purpose. Helmet arrangements where each side of the helmet has one single snap and one double snap set can be used.

In a most preferred embodiment, some or all of the snaps set 50 can rotate with regard to the shell 12. Snaps sets can be fixed to the shell using a pivoting connector 56. FIG. 6 includes an arrow indicating the snap set's ability to rotate around a pivoting connector. FIG. 2 shows a close-up of one possible pivoting connector embodiment. In this example the pivoting connector consists of a shoulder screw 61 passing through a washer 62, a snaps set 50, and the shell 12, and being screwed into a T-nut 60 from the inside of the shell. The washer is adapted to facilitate rotation. Persons of skill in the art will appreciate that other arrangements allowing the snaps set 50 to rotate on the shell 12 are possible. The snaps set 50 may be adapted to rotate about its center, as shown in the examples, including FIG. 6, or elsewhere. For example, it is possible for the pivot point of a snap set to be one of the second snaps 54, the snap set 50 being rotatable around one of the two snaps.

The double snaps and the pivoting snaps set of the present invention can be adapted for use with most football helmets known in the art, and also for non-football helmets.

Fixing each chin strap to the helmet shell using two snaps instead of one potentially doubles the strength of the connection, while still allowing players to undo the attachment when they choose to. This makes it less likely that the chin protectors will come off accidentally during a game, and thus less likely that the entire helmet will also come off.

Prior art helmets include chin straps that are attached to the shell using a single snap fastener. Often this is a rotatable connection which allows the strap to orient higher or lower with respect to the helmet shell by pivoting at the snap. It is advantageous to have straps 34 which can pivot with regard to the shell so that the chin cup 32 can be adjusted to accommodate players having heads of various shapes and sizes. If two standard snap fasteners are attached directly to a helmet, however, and a chin strap is snapped on to both fasteners, the strap will not be able to pivot at the connection. This is true even if each connection on its own is rotatable. Consider, analogously, how a board loosely nailed down at a single point can rotate around the nail, while a board loosely nailed down at two points cannot rotate at all. Thus, its is particularly desirable to combine the added connection strength of two snaps with the pivoting ability of a single snap.

Applicant has solved this problem by providing pairs of helmet-side snaps—second snaps 54—on pivoting, rotatable snaps set 50. This allows pairs of snaps 54 to pivot or rotate together with respect to the helmet shell 12. This, in turn, allows the buckles 40, and chin straps 34 attached to the buckles, to pivot as well.

The snaps set 50 may simply comprise a small piece of hard plastic carrying a pair of second snaps, as shown in FIGS. 1, 2, and 6. Persons of skill in the art will recognize that other embodiments having different shapes and using different materials can easily serve the same purpose. Rotating snaps set 50 could alternatively include more than two snaps, or include reversible attaching means other than conventional snaps. The pivoting connector 56 can also take a variety of rotating or pivoting forms, such as pivoting rivets, and is not limited to screw and washer arrangements.

The snap set may rotate around a pivoting connector 56 located between the second snaps 54 as illustrated in FIG. 6. Alternatively, as mentioned above, it may rotate around a different point such as, for example, the center of one of the snaps which doubles as a pivoting connector. The pivot point can also be a point in line with, but outside of, the second snaps, or to the side of the both second snaps. These variations can be accomplished by providing a pivoting connector 56 in different locations.

Similarly, the design of the buckles 40 carrying first snaps 44 can vary within the scope of this invention. Different shapes and materials can be employed. Each buckle can carry two or more than two first snaps, or may carry reversible connecting means other than conventional snaps. Connector means 42 may include different arrangements of one or more slots for receiving a chin strap 34, or may include means such as clamps which do not involve slots. Buckles which are permanently attached to chin straps, or chin straps which include a plurality of first snaps and do not require buckles, are also possible. Alternatively, each chin strap could engage a plurality of buckles, each buckle having only a single first snap, the buckles collectively attaching each strap to the shell at a plurality of points.

The side portions 18 of the shell may not be clearly separated from other portions of the shell. As used in the claims, the term "side portions" should be construed broadly, such as by including areas which could arguably also be described as being front 14 or crown 16 portions. This is particularly true regarding the location of the second snaps 54 and snaps sets 50 which may be located somewhat higher on the helmet, such as near the wearer's temples, in certain embodiments.

While a specific embodiment of the invention has been shown and described in detail to illustrate the application of the principles of the invention, it will be understood that the invention may be embodied otherwise without departing from such principles. In some embodiments of the invention, certain features of the invention may sometimes be used to advantage without a corresponding use of the other features. Accordingly, all such changes and embodiments properly fall within the scope of the following claims.

What is claimed is:

1. In a football helmet combination (10) having a rigid plastic shell (12) adapted to cover the head of a wearer and a chin protector (30) adapted to cover the chin of the wearer and to hold the shell to the wearer's head, the rigid shell having an outer surface with a front portion (14), a crown portion (16), a pair of opposite side portions (18), a back portion (20), and a face mask (80), the chin protector having a chin cup (32) and two pairs of chin straps (34) connected to the chin cup and extending to the opposite side portions of the shell, the improvement comprising:

a plurality of buckles (40) each having a connector (42) for connecting each buckle at a location along a length of one of the chin straps (34), each buckle having a pair of first snaps (44), each snap of the pair of first snaps (44) being selected from the group consisting of a male type and female type;

two snaps sets (50) on each of the opposite sides (18) of the shell, each snaps set (50) adapted for snapping connection to one of the buckles, each snap set comprising a base (51) and a pair of second snaps (54) being spaced the same distance apart on the base (51) as a pair of first snaps on the buckle to be engaged, each of the pair of the second snaps being selected from the group consisting of a male type and a female type and being adapted to snap to a respective first snap on the buckle to be engaged, wherein the base (51) of each snaps set (50) comprises a first side facing the plastic shell (12) of the helmet, and a second side facing away from the plastic shell (12) and carrying said pair of second snaps so that both second snaps are oriented away from the plastic shell (12);

wherein each snaps set (50) is rotatably attached to the rigid plastic shell (12) by a pivoting connector (56);

wherein the first snaps (44) and second snaps (54) are adapted for securely and reversibly snap connecting each chin strap (34) to a side portion (18) of the shell (12) via a buckle (40) and a snaps set (50);

wherein said chin protector comprises four chin straps (34), each chin strap being connected to a buckle (40);

wherein each buckle (40) is connected to one of said snaps sets (50) by two second snaps engaged to two first snaps;

wherein the chin protector is thereby pivotally fixed to the rigid shell (12) through said four chin straps (34) engaged respectively to four rotatable snaps sets (50);

wherein said male type snaps each comprise a round protrusion; and wherein said female type snaps each comprise a round cavity complimentary to the round protrusions of said male type snaps and shaped for receiving said round protrusions.

2. The football helmet combination of claim 1:

wherein the pivoting connectors (56) each comprise a screw (61), a washer (62), and a nut (60), the screw passing through the thickness of the helmet shell (12) and a snaps set (50); and wherein the pivoting connectors are adapted to allow their respective snaps sets (50) to rotate about the axis of the screw (61).

3. The football helmet combination of claim 1, wherein the pair of second snaps being provided on opposite sides of the pivoting connector (56), and the pivoting connector being between the two second snaps in each pair of second snaps.

4. The football helmet combination of claim 1, wherein each set of first snaps (44) comprises two female type snaps, and wherein each set of second snaps (54) comprises two male type snaps.

5. The football helmet combination of claim 1, wherein each set of first (44) snaps comprises two male type snaps, and wherein each set of second snaps (54) comprises two female type snaps.

6. The football helmet combination of claim 1, wherein each set of first (44) snaps and each set of second snaps (54) each comprise both one male type snap, and one female type snap.

7. The football helmet combination of claim 1, wherein the connectors (42) of the buckles (40) comprise slots for slidably receiving chin straps (34).

8. The football helmet combination of claim 1, wherein the connectors (42) of the buckles (40) each comprise slots for slidably receiving said chin straps (34), the buckles being adapted to slide along the chin straps (34) and thereby adjust the location of the buckles (40) along the chin straps (34);

wherein all snaps sets (50) are rotatable with respect to the helmet shell (12); and wherein a position of the chin cup (32) relative to the helmet shell (12) is adjustable by sliding the buckles (40) along the chin straps (34) to control the distance between the snaps set (50) and the chin cup (32), and by rotating the snaps set (50) and chin straps (34) engaged thereto to rotate the chin cup (32) with respect to the helmet shell (12).

9. The football helmet combination of claim 1:

wherein the bases (51) of the snaps sets (50) are at least partially planar.

* * * * *